US008693930B2

(12) United States Patent
Maeda

(10) Patent No.: US 8,693,930 B2
(45) Date of Patent: Apr. 8, 2014

(54) IMAGE FORMATION DEVICE AND IMAGE CORRECTION METHOD

(75) Inventor: Hiroyuki Maeda, Toyokawa (JP)

(73) Assignee: Konica Minolta Business Technologies, Inc, Chiyoda-Ku, Tokyo (JP)

( * ) Notice: Subject to any disclaimer, the term of this patent is extended or adjusted under 35 U.S.C. 154(b) by 446 days.

(21) Appl. No.: 13/176,197

(22) Filed: Jul. 5, 2011

(65) Prior Publication Data

US 2012/0008993 A1 Jan. 12, 2012

(30) Foreign Application Priority Data

Jul. 7, 2010 (JP) ..... 2010-155205

(51) Int. Cl.
*G03G 15/00* (2006.01)

(52) U.S. Cl.
CPC ..... *G03G 15/5058* (2013.01)
USPC ..... 399/301; 399/10; 399/49

(58) Field of Classification Search
CPC ..... G03G 15/5079; G03G 15/5075
USPC ..... 399/10, 46, 49, 301
See application file for complete search history.

(56) References Cited

U.S. PATENT DOCUMENTS

| | | | | |
|---|---|---|---|---|
| 5,838,465 | A | 11/1998 | Satou et al. | |
| 6,418,295 | B1 | 7/2002 | Sato | |
| 7,333,758 | B2 | 2/2008 | Munakata et al. | |
| 7,664,412 | B2 | 2/2010 | Taguchi et al. | |
| 2008/0292370 | A1 * | 11/2008 | Murayama | 399/301 |
| 2009/0142084 | A1 * | 6/2009 | Nakahata | 399/51 |
| 2011/0193922 | A1 * | 8/2011 | Teshima et al. | 347/116 |

FOREIGN PATENT DOCUMENTS

| | | | |
|---|---|---|---|
| JP | 08-160704 | A | 6/1996 |
| JP | 2000-305340 | A | 11/2000 |
| JP | 2002-236405 | A | 8/2002 |
| JP | 2006-047547 | A | 2/2006 |
| JP | 2006-201339 | A | 8/2006 |
| JP | 2006-201341 | A | 8/2006 |
| JP | 2007-025407 | A | 2/2007 |

(Continued)

OTHER PUBLICATIONS

Office Action (Notification of Reasons for Refusal) dated May 22, 2012, issued in corresponding Japanese Patent Application No. 2010-155205, and an English Translation thereof (with Verification of Translation). (6 pages).

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

An image formation device comprises imaging units creating toner images in a corresponding color; an intermediate transfer body where the toner images are overlaid in a primary transfer; a secondary transfer unit performing secondary transfers of the overlaid toner images onto a recording sheet; a first misregistration correction unit operable to cause each imaging unit to form a reference pattern, execute a first misalignment reading acquisition process of acquiring a misalignment reading for each pattern, and adjust the imaging units to correct the readings; a storage unit storing the readings; and a second misregistration correction unit operable to cause an imaging unit subset to form reference patterns, execute a second misalignment reading acquisition process of acquiring readings for the subset of patterns and estimating readings in colors for which no pattern is formed from the acquired readings and the stored readings, and adjust the imaging units to correct all readings.

14 Claims, 9 Drawing Sheets

(56) References Cited

FOREIGN PATENT DOCUMENTS

| | | | |
|---|---|---|---|
| JP | 2007-155895 | A | 6/2007 |
| JP | 2010-107539 | A | 5/2010 |
| JP | 2010-145626 | A | 7/2010 |
| WO | 2006/025361 | A1 | 3/2006 |

* cited by examiner

IMAGE FORMATION DEVICE AND IMAGE CORRECTION METHOD

This application is based on application No. 2010-155205 filed in Japan, the content of which is hereby incorporated by reference.

BACKGROUND OF THE INVENTION (1) Field of the Invention

The present invention relates to an image formation device for a photocopier or similar, and particularly concerns technology for improving color image corrections.

(2) Description of the Related Art

Take, for example, a tandem color image formation device. In such a device, imaging units in each of a set of colors, each centered on a photosensitive drum and transfer equipment, are arranged along an intermediate transfer belt. Each of the imaging units forms a latent image on the photosensitive drum thereof upon exposure to a sweeping light beam from an exposure unit. After the formation of toner images developed through the application of toner to the latent images, the toner images are overlaid in a primary transfer to the intermediate transfer belt, followed by a secondary transfer at a secondary transfer position to a recording sheet passing between the intermediate transfer belt and an adjacent secondary transfer roller of each toner image into a single whole.

In such a color image formation device, misregistration can occur as a result of exposure position discrepancies (writing misalignment) in the light beam for each color. This problem is caused by mounting position changes that occur when the imaging units or the intermediate transfer unit are replaced, and by expansion or contraction of the photosensitive drums, intermediate transfer belt, and the casing for the imaging units that accompanies internal temperature changes.

This misregistration can be prevented by first having the imaging units in each of four colors, cyan (C), magenta (M), yellow (Y), and black (K), form reference patterns of a predetermined shape in each respective color on the intermediate transfer belt, then having an optical sensor take misalignment readings from the reference patterns in each color, and finally performing image writing position corrections according the misalignment readings so taken (overall process hereinafter referred to as misregistration corrections). Incidentally, forming reference patterns in all four colors for each misregistration correction process consumes a great deal of color toner and also requires an ample amount of processing time.

Japanese Patent Application Publication No. 2006-201339 discloses technology for suppressing toner consumption and reducing processing time needed for misregistration correction. This technology involves reducing the incidence of registration discrepancies in the photosensitive units (imaging units) of each color by driving the C, M, and Y units with a common motion lever as a single whole when pressing and separating the units onto and from the intermediate transfer belt. Therefore, predicated on the absence of registration discrepancies between the color (C, M, and Y) photosensitive units, register marks (registration patterns) can be formed in any one of these colors and in the K color such that misregistration corrections for the one color are also applicable to registration adjustments (misregistration corrections) made in the other colors.

Also, Japanese Patent Application Publication No. 2006-201341 discloses other technology in which the photosensitive units in each (C, M, and Y) color are unified into one, thus reducing the incidence of registration discrepancies between the color photosensitive units. Much as above, predicated on the absence of registration discrepancies between the color photosensitive units, register marks (registration patterns) can be fowled in any one of these colors (C, M, or Y) and in the K color such that misregistration corrections for the one color are also applicable to registration adjustments (misregistration corrections) made in the other colors.

However, according to the structures of Japanese Patent Application Publications No. 2006-201339 and 2006-201341, the unified color photosensitive units may yet undergo expansion or contraction due to internal temperature changes. Thus, misregistration caused by such temperature changes cannot be completely suppressed therein.

Nevertheless, using the misregistration correction reading from a register pattern formed in one of the three colors as-is for the other colors may lead to image quality degradation as appropriate misregistration corrections are not applied to the other colors.

In addition, the need to provide a motion lever or other mechanism combining the photosensitive units in order to minutely preserve the positions thereof contributes to cost escalation.

SUMMARY OF THE INVENTION

The image formation device pertaining to the present invention comprises a plurality of imaging units each operable to create toner images in a corresponding color; an intermediate transfer body on which the toner images are overlaid in a primary transfer; a secondary transfer unit operable to perform a secondary transfer of the toner images so overlaid onto a recording sheet; a first misregistration correction unit operable to cause the imaging units to form a reference pattern in each color on the intermediate transfer body, execute a first misalignment reading acquisition process to acquire a misalignment reading for each of the reference patterns, and adjust the imaging units so as to correct the misalignment readings so acquired; a storage unit storing therein the misalignment readings for the reference patterns in each color acquired by executing the first misalignment reading acquisition process; and a second misregistration correction unit operable to cause each of a subset of the imaging units to form a reference pattern in the corresponding color on the intermediate transfer body, execute a second misalignment reading acquisition process, the second misalignment reading acquisition process consisting of: acquiring misalignment readings for the reference patterns formed by the subset of the imaging units, and estimating misalignment readings in each color for which a reference pattern is not formed by the subset of the imaging units according to the misalignment readings so acquired and the misalignment readings stored in the storage unit, and adjust the imaging units so as to correct all of the misalignment readings so acquired.

The image correction method pertaining to the present invention is executed by an image formation device for forming color images through a primary transfer, in which toner images formed by a plurality of imaging units for forming the toner images in a corresponding color are overlaid on an intermediate transfer body, and a secondary transfer, in which the toner images are transferred to a recording sheet, comprises: a first misregistration correction step including: a first misalignment reading acquisition sub-step of causing the imaging units to form a reference pattern in each color on the intermediate transfer body and executing a first misalignment reading acquisition process to acquire a misalignment reading for each of the reference patterns; and a first misalignment reading correction sub-step of adjusting the imaging units so as to correct the misalignment readings acquired in the first misregistration reading acquisition sub-step; a storage step of storing, in a storage unit, the misalignment readings for the reference patterns in each color acquired in the first misalignment reading acquisition sub-step; and a second misregistration correction step including: a second misalignment reading acquisition sub-step of causing each of a subset of the imaging units to form a reference pattern in the corresponding color on the intermediate transfer body and executing a second misalignment reading acquisition process, the second misalignment reading acquisition process consisting of acquiring misalignment readings for the reference patterns formed by the subset of the imaging units, and estimating misalignment readings in each color for which a reference pattern is not formed by the subset of the imaging units according to the acquired misalignment readings and the misalignment readings stored in the storage unit; and a second misalignment reading correction sub-step of adjusting the imaging units so as to correct all of the misalignment readings acquired in the second misalignment reading acquisition sub-step.

BRIEF DESCRIPTION OF THE DRAWINGS

These and other objects, advantages, and features of the invention will become apparent from the following description thereof taken in conjunction with the accompanying drawings that illustrate a specific embodiment of the invention.

In the drawings.

DESCRIPTION OF THE PREFERRED EMBODIMENT

The following describes a tandem-type color digital photocopier (hereinafter termed a copier) according to an Embodiment of the present invention with reference to the drawings.

Preferred Embodiment

1. Overall Copier Configuration

Figure 1:
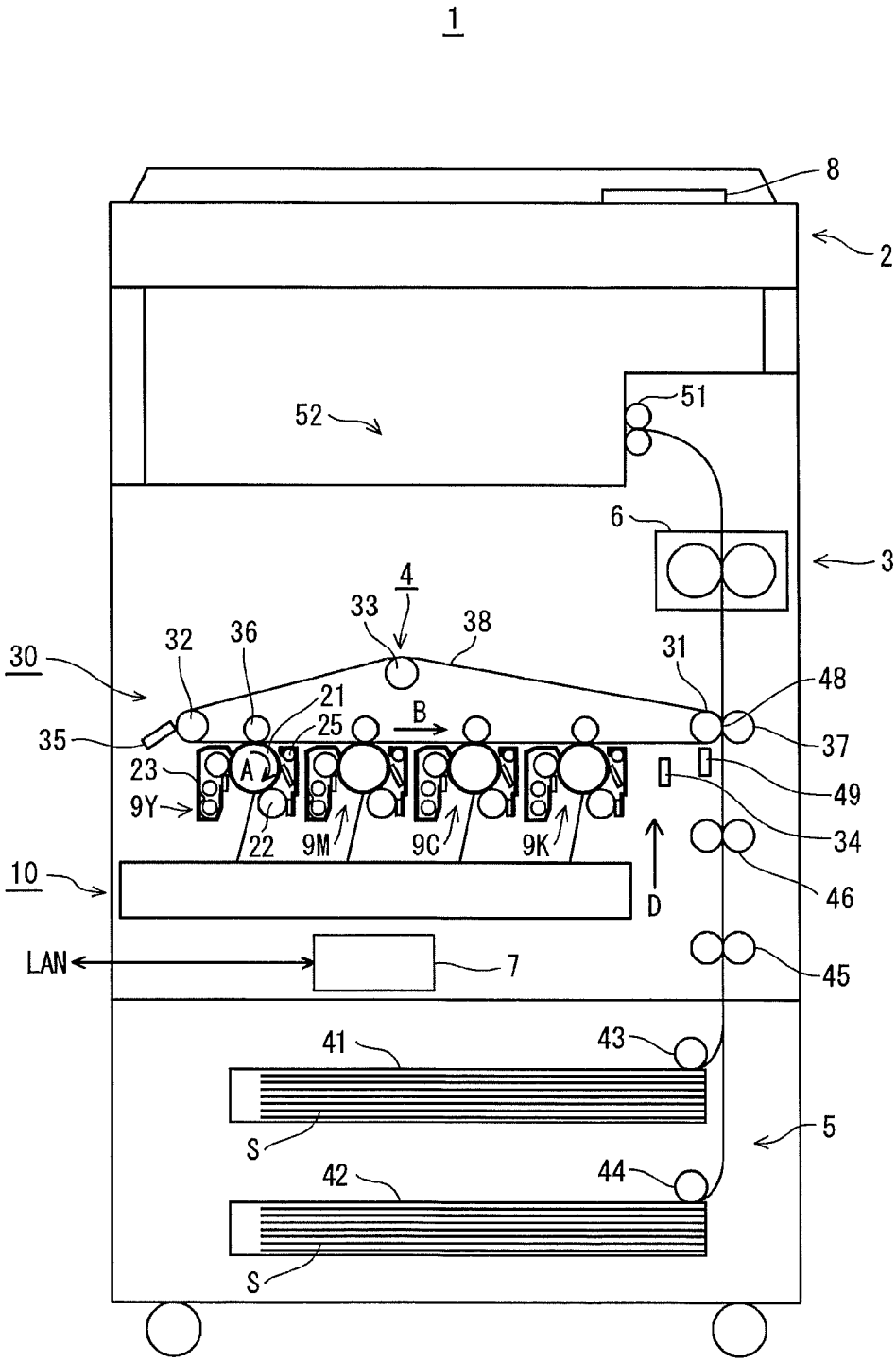
FIG. 1 is a schematic diagram illustrating the overall configuration of a copier 1 pertaining to an Embodiment of the present invention.

FIG. 1 is a schematic diagram illustrating the overall configuration of the copier 1. As shown, the copier 1 comprises a scanning unit 2 and a printing unit 3. Being able to perform copy jobs consisting of forming an image on a recording sheet according to image data read from an original image, print jobs consisting of forming an image on a recording sheet according to image data transmitted from an external terminal via a network, transmission jobs consisting of transmitting image data to an external unit, and more, the copier is also called a MFP (Multiple Function Peripheral).

The scanning unit 2 is a known apparatus capable of obtaining image data by reading an original image set thereon.

The printing unit 3 forms images through the electrophotographic printing method or similar, and comprises an image processing unit 4, a recording sheet feed unit 5, a fixing unit 6, and a control unit 7.

The image processing unit 4 comprises imaging units 9C, 9M, 9Y, and 9K each corresponding to the color reproduced thereby, namely cyan (C), magenta (M), yellow (Y), and black (B), as well as an exposure unit 10, an intermediate transfer unit 30, and so on.

The intermediate transfer unit 30 comprises a driving roller 31, a driven roller 32, a tension roller 33, an intermediate transfer belt 38, a cleaning blade 35, primary transfer rollers 36, and a secondary transfer roller 37.

The intermediate transfer belt 38 overspans the driving roller 31, the driven roller 32, and the tension roller 33, being driven to rotate in the direction indicated by arrow B.

The primary transfer rollers 36 are each disposed opposite one of a plurality of photosensitive drums 21 so as to sandwich the intermediate transfer belt 38.

The imaging units 9C, 9M, 9Y, and 9K are disposed so as to face the intermediate transfer belt 38 and arranged serially from an upstream side to a downstream side at predetermined intervals along the direction of belt travel. Imaging unit 9C comprises a photosensitive drum 21 serving as an image carrier, as well as a charging unit 22, a developing unit 23, a cleaner 25, and so on, which are disposed therearound. This configuration is shared by the other imaging units 9M, 9Y, and 9K, and the reference symbols therefor are thus omitted from FIG. 1. The components of each imaging unit are hereinafter distinguished through a letter corresponding to the color reproduced thereby, namely C, M, Y, or K, appended to the reference numbers.

In each of the imaging units 9C, 9M, 9Y, and 9K, the photosensitive drum 21C, 21M, 21Y, and 21K, which rotates in the direction indicated by arrow A, is uniformly charged by the charging unit 22C, 22M, 22Y, and 22K after being cleaned by the cleaner 25C, 25M, 25Y, and 25K. Latent images are then formed by exposing the surface of each charged photosensitive drum 21C, 21M, 21Y, and 21K to laser light from the exposure unit 10. The latent images so formed are then developed with toner by the developing unit 23C, 23M, 23Y, and 23K. A primary transfer voltage is applied to the primary transfer rollers 36C, 36M, 36Y, and 36K. The developed toner image in each color is made to undergo a primary transfer from the photosensitive drums 21C, 21M, 21Y, and 21K to the intermediate transfer belt 38 by the electric field of the primary transfer rollers 36C, 36M, 36Y, and 36K. Here, the image creation process is performed in each color with a timing offset such that the toner images transferred to the intermediate transfer belt 38 are overlaid at the same position. The movement of the intermediate transfer belt 38 acts to carry the toner images in each color thereon to the secondary transfer position 48.

The cleaning blade 35 cleans the intermediate transfer belt 38 in preparation for subsequent image formation by removing any toner remaining thereon after the toner images are transferred to the recording sheet at the secondary transfer position 48.

The feed unit 5 comprises paper take-up cassettes 41 and 42 that contain recording sheets S therein, feed rollers 43 and 44 that feed recording sheets S contained in the paper take-up cassettes 41 and 42 one at a time, a pair of transport rollers 45 that transport the recording sheets S fed thereto, a pair of timing rollers 46 that time the sending of the recording sheets S to the secondary transfer position 48, the secondary transfer roller 37 that pressurizes the driving roller 31 so as to sandwich the intermediate transfer belt 38 therebetween at the secondary transfer position 48, and so on. The fixing unit 6 comprises a heater (not diagrammed) that maintains a predetermined fixing temperature.

Upon passing through the secondary transfer position 48, one of the recording sheets S is transported to the fixing unit 6 where a toner image is fixed thereon through the application of heat and pressure. Afterward, the recording sheet S is discharged from the apparatus by a pair of exit rollers 51 and stored in a storage tray 52.

A control panel 8 is provided in an easily-accessible position at the front of the scanning unit 2. The control panel 8 comprises a numeric keypad with which to input a copy quantity, a copy start key with which to make a copy start instruction, and keys for selecting an image formation mode, as well as a liquid crystal display unit in the form of a touch panel configured to display messages relating to the status of copier 1, such as waiting for a job execution instruction (standby mode).

An environmental sensor 49 is also provided within the copier 1 in the vicinity of the driving roller 31 to take temperature and humidity readings. Signals indicating the temperature and humidity readings are sent to the control unit 7 from the environmental sensor 49.

2. Control Unit 7 Configuration

Figure 2:
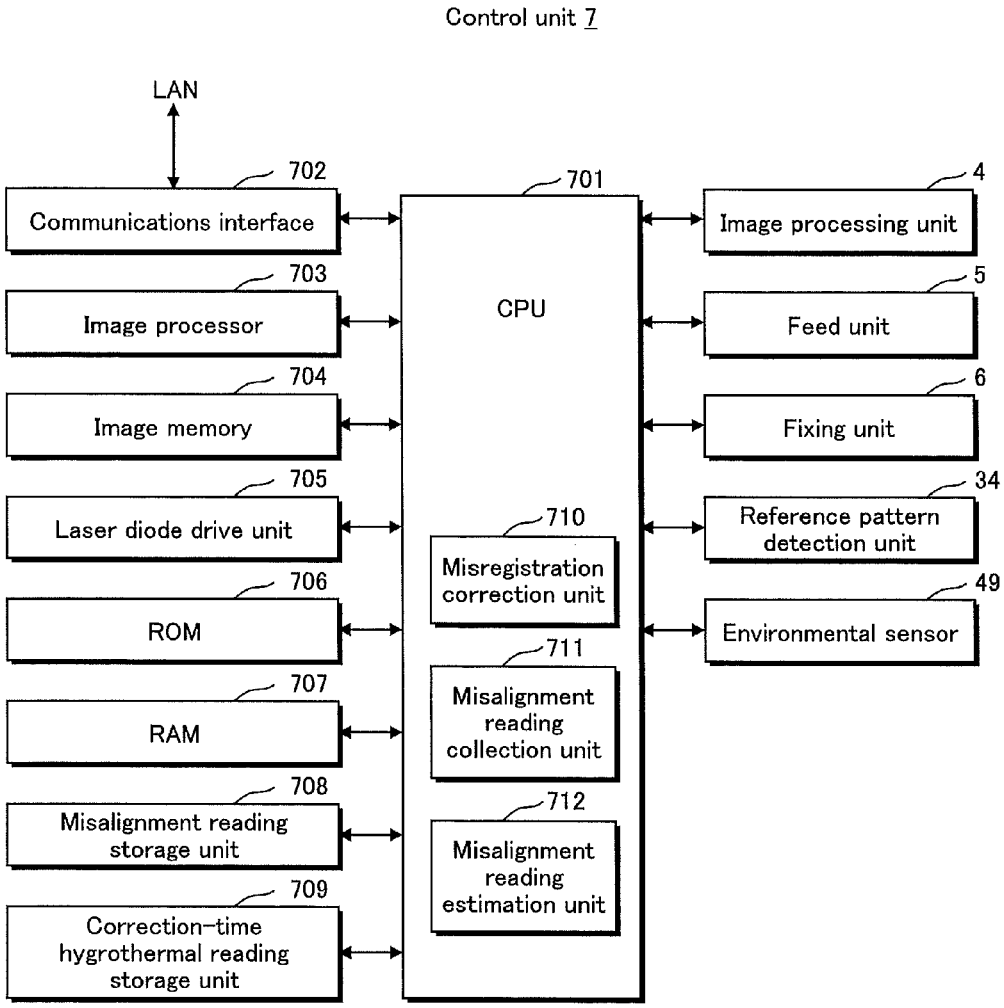
FIG. 2 is a block diagram illustrating the schematic configuration of a control unit of the copier 1.

FIG. 2 is a block diagram illustrating the schematic configuration of the control unit 7. As shown, the principal components of the control unit 7 include a CPU (Central Processing Unit) 701, a communications interface 702, an image processing unit 703, an image memory 704, a laser diode drive unit 705, ROM (Read-Only Memory) 706, RAM (Random Access Memory) 707, a misalignment reading storage unit 708, a correction-time hygrothermal reading storage unit 709, and a misregistration correction unit 710.

The communications interface 702 is an interface such as a LAN (Local Area Network) card or board for receiving print job data from an exterior source and transmitting the data so received to the image processing unit 703.

The image processing unit 703 converts the print job data received from the network interface 702 into image data in each of the colors C, M, Y, and K, then outputs the result to the image memory 704, which stores the image data in each color therein.

The laser diode drive unit 705 reads the image data in each color from the image memory 704 with timing corresponding to that at which a K-color reference image is written, and drives the (non-diagrammed) laser diode of the exposure unit 10 accordingly.

The ROM 706 stores programs therein, such as a control program for image formation operations and a control program for misalignment detection, and printing data for register patterns in each color. The RAM 707 is used as the work area for the CPU 701.

The CPU 701 reads needed programs from the ROM 706, uniformly controls and times the operations of the image processing unit 4, the fixing unit 6, and so on, and smoothly executes printing operations according to print job data received from the communications interface 702. Also, the CPU 701 receives detection signals from the environmental sensor 49 and from a reference pattern detection unit 34, reads needed programs from the ROM 706, and controls the image data conversion process by the image processing unit 703, the reading and writing of image data in the image memory 704, and the correction of image data by the misregistration correction unit 710, which is performed according to a misalignment reading for each color calculated by a later-described misalignment reading collection unit 711.

The CPU 701 is not restricted to a single CPU but may also consist of a plurality of CPUs working in unison.

The misalignment reading collection unit 711 forms a functional portion of the CPU 701 and is configured to receive readings from the reference pattern detection unit 34 to calculate a misalignment reading in each color through a misalignment detection process.

The misalignment reading estimation unit 712 forms a functional portion of the CPU 701 and is configured to receive readings from the reference pattern detection unit 34, read out past misalignment readings from the later-described misalignment reading storage unit 708, and estimate misalignment readings for colors other than the color for which readings have been received from the reference pattern detection unit 34. The details will be described later.

The misalignment reading storage unit 708 is either volatile memory, such as RAM, or non-volatile memory, such as EEPROM (Electrically Erasable and Programmable Read Only Memory), storing therein misalignment readings in each of a primary scanning direction and an auxiliary scanning direction calculated when misregistration correction is executed, as well as skew reading information. The misalignment reading storage unit 708 need not be an independent memory device and may also be realized as a function of the RAM 707.

The correction-time hygrothermal reading storage unit 709 is non-volatile memory, such as EEPROM, storing therein temperature and humidity information as read by the environmental sensor 49 during the most recent misregistration correction process.

The misregistration correction unit 710 forms a functional portion of the CPU 701 and makes needed corrections to the timing, with respect to a reference color, at which other colors are written so that misregistration does not occur at image formation time during a print job. Such corrections are made according to misalignment reading information stored in the misalignment reading storage unit 708 and/or misalignment reading information obtained by the misalignment reading collection unit 711. In the present Embodiment, the color K is used as the reference color.

3. Misregistration Correction Process

The most common causes of misregistration are minute mounting misalignments occurring when the imaging units or the intermediate transfer unit are replaced, and expansion or contraction of the photosensitive drums, intermediate transfer belt, the cases housing the imaging units, and so on, due to hygrothermal changes within the apparatus.

The inventors have discovered that misregistration owing to the latter cause exhibits a correlation with misalignment readings for each of the colors C, M, Y, and K. Therefore, given misalignment reading data previously measured at least once for all four colors C, M, Y, and K, misalignment readings can be estimated for all remaining colors according to a misalignment reading for any one of the colors.

Misalignment in the auxiliary scanning direction is calculated by measuring the distance between a reference pattern in one color and a reference pattern in the other colors. Thus, reference patterns in at least two colors must be formed in order to calculate misalignment readings.

Accordingly, if reference patterns are written for two of the four colors C, M, Y, and K so that misalignment readings can be calculated for these two colors, misalignment readings for the two remaining colors can then be estimated.

The present Embodiment describes a structure in which misregistration correction is performed for both possible causes. In the former case, misalignment readings are measured from reference patterns formed in all of the colors C, M, Y, and K, so as to carry out corrections according to misalignment readings in each color according to these measurements. In the latter case, misalignment readings are calculated from reference patterns formed in only two of the colors C, M, Y, and K, so as to carry out corrections after estimating misalignment readings for the two remaining colors from the measurements so obtained.

(3-1. First Misregistration Correction Process)

As shown in FIG. 1, the reference pattern detection unit 34 is provided at a position downstream from the imaging unit 9K and upstream from the secondary transfer position 48 along the direction of belt travel so as to face the surface of the intermediate transfer belt 38.

Figure 3:
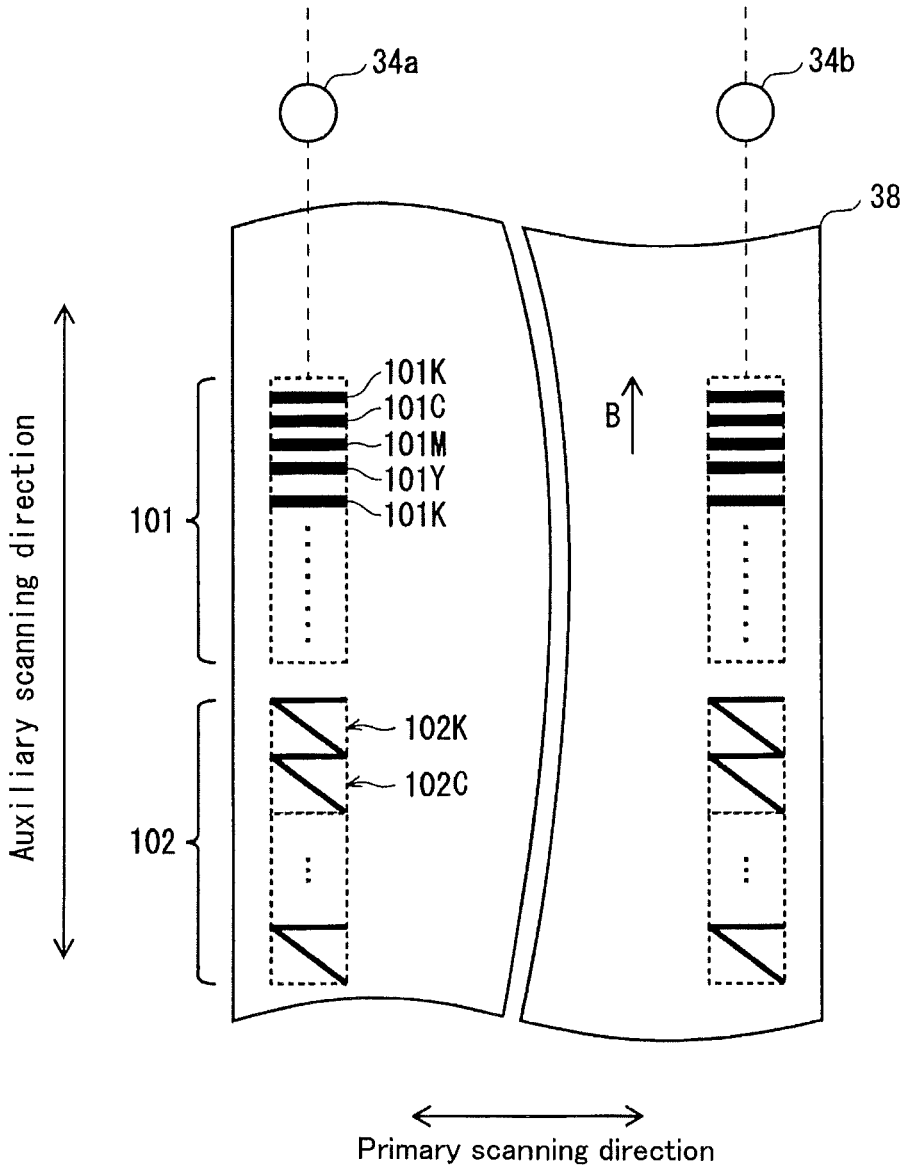
FIG. 3 is an example of a reference pattern for taking misalignment readings during a misregistration correction process.
Figure 4:
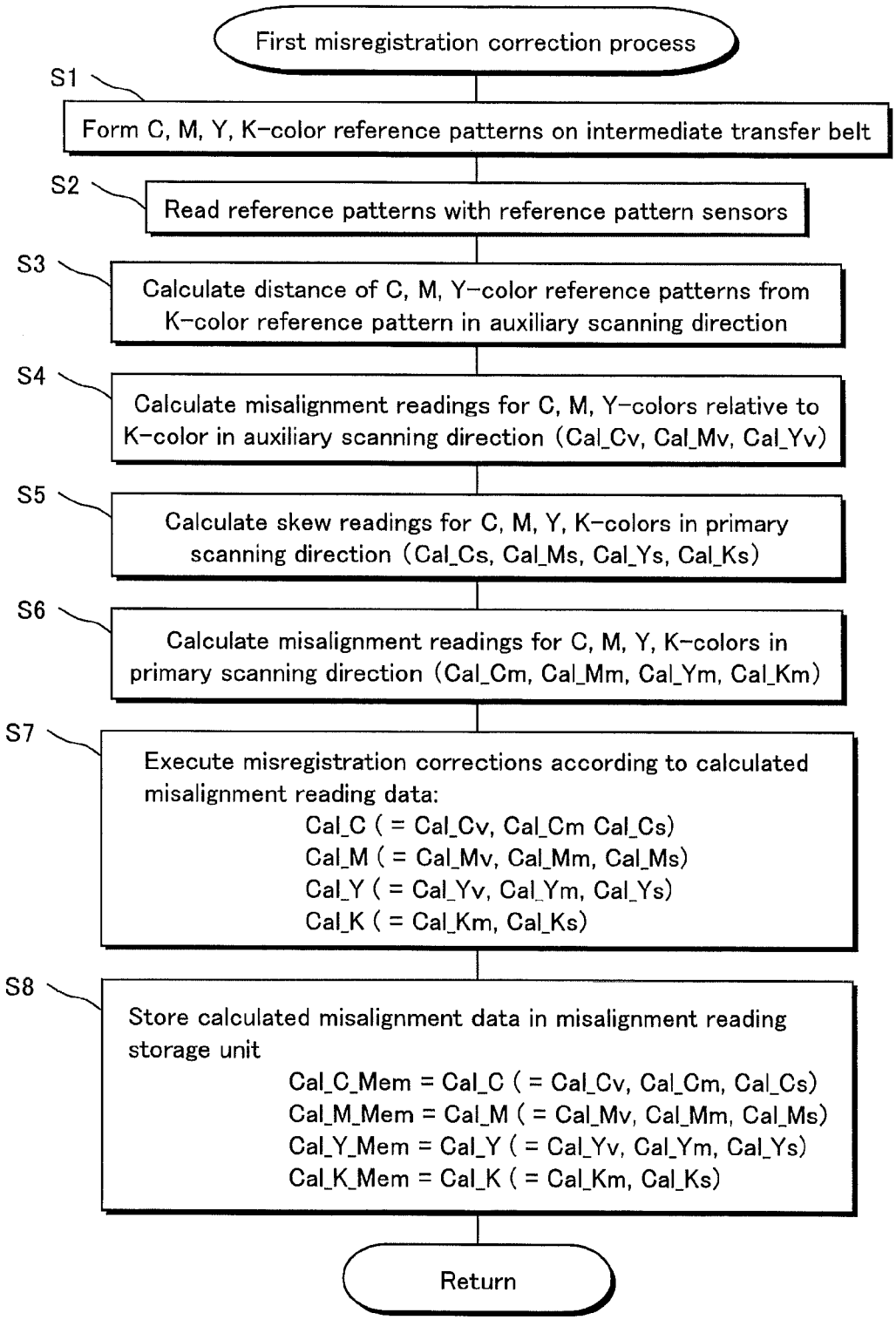
FIG. 4 is a flowchart showing the content of a first misregistration correction process.

The reference pattern detection unit 34 has two reference pattern sensors 34*a* and 34*b* (see FIG. 3) disposed at predetermined intervals along a straight line (in a direction perpendicular to the direction of belt travel B (corresponding to the auxiliary scanning direction)) that is the primary scanning direction. FIG. 3 shows the positional relationship between the intermediate transfer belt 38 and the reference pattern sensors 34*a* and 34*b* as seen from the direction indicated by arrow D in FIG. 1. Each of the reference pattern sensors 34*a* and 34*b* is a reflective optical sensor comprising a light-emitting element, such as a LED (Light-Emitting Diode), and a light-receiving element, such as a photodiode. Thus, the reference pattern sensors 34*a* and 34*b* are able to detect reference pattern 101 and the like, which are formed on the surface of the intermediate transfer belt 38. Misalignment readings in each color can then be calculated according to the reference pattern information so detected. Although the misalignment reading detection method is widely known and thus omitted from this explanation, a flowchart illustrating an outline of the method is presented in FIG. 4. FIG. 4 illustrates the process flow for a first misregistration correction process, in which misalignment readings in each color are taken from the reference patterns formed in all of the colors C, M, Y, and K. This process is thus incorporated in the flow of the later-described print job execution process (see FIG. 8) as a subroutine.

First, two reference patterns 101 and 102 are formed at respective positions corresponding to the ends of the primary scanning direction along the intermediate transfer belt 38, as shown in FIG. 3 (step S1). Reference pattern 101 is made up of reference patterns 101K, 101C, 101M, 101Y . . . in straight, linear portions of each color, running parallel to the primary scanning direction. Reference pattern 102 is made up of reference patterns 102 K, 102C, 102M, 102Y . . . in V-shaped segments formed by first, straight linear portions and second linear portions at 45° angles to the first linear portions. As long as misregistration does not occur, the reference patterns are each formed at the same position in the primary scanning direction and offset in the auxiliary scanning direction by a predetermined distance. The reference patterns so formed pass by the detection positions of the reference pattern sensors 34*a* and 34*b* due to the motion of the intermediate transfer belt 38. At this point, the patterns are respectively read along the direction of the dotted lines shown (step S2).

The distances of the C, M, and Y-colored reference patterns from the reference position of the K-colored reference pattern in the auxiliary scanning direction are computed from the reference pattern 101 readings taken by the reference pattern sensors 34*a* and 34*b* (step S3). The differences between the distances so computed and distances expected in the absence of misregistration are then used to calculate misalignment readings in the auxiliary scanning direction (Cal_Cv, Cal_Mv, Cal_Yv) (step S4).

Subsequently, skew readings (Cal_Cs, Cal_Ms, Cal_Ys, Cal_Ks) are calculated for each color C, M, Y, and K from the formation positions of two reference patterns at the sides of the primary scanning line (step S5).

Then, the line spacing between the first linear portions and the second linear portions in each color C, M, Y, and K is computed from the reference pattern 102 readings in order to calculate misalignment readings in the primary scanning direction (Cal_Cm, Cal_Mm, Cal_Ym, Cal_Km) from a line spacing difference in each color (step S6).

The misregistration correction unit 710 performs image data address changes and the like according to the calculated misalignment reading data, namely Cal_C (i.e., Cal_Cv, Cal_Cm, and Cal_Cs), Cal_M (i.e., Cal_Mv, Cal_Mm, and Cal_Ms), Cal_Y (i.e., Cal_Yv, Cal_Ym, and Cal_Ys), and Cal_K (i.e., Cal_Km and Cal_Ks), so as to correct misalignment and skew in the primary and auxiliary scanning directions. Thus, widely-known image writing misalignment correction (misregistration correction) is executed through pixel-level memory address modifications to the write position of the color images for each of the photosensitive drums 21C, 21M, 21Y, and 21K, in turn controlling color image formation so that misregistration does not occur therein (step S7).

The image data address modifications may be replaced by modifications to the image data read time or the like to obtain the same effect. The misregistration correction process is similarly executed hereinafter.

The notation Cal_C is hereinafter used to encompass the C-color misalignment reading in the primary scanning direction Cal_Cm, the misalignment reading in the auxiliary direction Cal_Cv, and the skew reading Cal_Cs. Similar notation is also used for the colors M, Y, and K.

The Cal_C, Cal_M, Cal_Y, and Cal_K data so calculated are respectively stored in the misalignment reading storage unit 708 as Cal_C_Mem, Cal_M_Mem, Cal_Y_Mem, and Cal_K_Mem (step S8). The process flow then returns to the print job execution process shown in FIG. 8.

Misalignment readings stored in the misalignment reading storage unit 708 are hereinafter indicated with the suffix_Mem.

If steps S1 through S6 of the first misregistration correction process illustrated by FIG. 4 as described above are considered to be a first misalignment reading acquisition process, then the misregistration correction unit 710 that executes the misregistration correction process in step S7 so as to correct the misalignment reading obtained during that process can be considered to be a first misregistration correction unit.

Steps S4, S5, and S6 need not necessarily be executed in the order indicated by FIG. 4, and may in fact be executed in any order, or even simultaneously. Furthermore, steps S7 and S8 need not necessarily be executed in the order indicated by FIG. 4, and may in fact be executed in reverse order, or simultaneously.

Furthermore, the reference patterns are not restricted to the above description. For example, reference pattern 102 may be used alone so as to use fewer marks of each color. If such a simplified approach is used, then the misalignment readings in the primary and auxiliary scanning directions can be calculated according to the formation position of each linear portion in the V-shaped marks. Of course, the detection precision is undeniably reduced to a certain extent in contrast to cases in which the above-described misalignment readings in the primary and auxiliary scanning directions are made individually with both reference patterns 101 and 102. However, due to the lower number of marks, toner consumption and the time required for taking readings can both be diminished.

In the present Embodiment, the first misregistration correction process is executed when the image formation apparatus is first used, when the power supply is switched on, when the imaging units are replaced, and when the intermediate transfer unit is replaced. The details will be described later.

(3-2. Second Misregistration Correction Process)

In addition to the first misregistration correction process described above, in which misregistration corrections are carried out according to misalignment readings taken by forming a reference pattern in each of four colors C, M, Y, and K, the present Embodiment also involves a second misregistration correction process, as follows. Misalignment readings are taken for reference patterns in two of the four colors and estimated for the remaining two colors according to the readings so taken and to past misalignment readings in all four colors stored in the misalignment reading storage unit 708. Misregistration corrections are then carried out according to the misalignment readings in the two colors actually read and the two estimated colors.

The second misregistration correction process is executed when the readings taken by the environmental sensor 49 indicate that the internal temperature or humidity of the apparatus have changed so as to be equal to or greater than predetermined values. The details will be described later.

In the present Embodiment, the second misregistration correction process only involves performing misalignment corrections (misregistration corrections) in the primary and auxiliary scanning directions, without performing skew corrections. Given that the principal causes of skew are owed to the minute mounting misalignment of the imaging units and the intermediate transfer unit, the skew imparted by hygrothermal variations during the operations of the image formation apparatus is not ordinarily sufficient to influence image quality. Thus, in the present Embodiment, skew corrections are carried out only in the first misregistration correction process and not in the second misregistration correction process.

As the second misregistration correction process does not involve skew corrections, either of the reference patterns formed on the intermediate transfer belt 38 at the two positions corresponding to the ends of the primary scanning direction shown in FIG. 3 may be used, alone.

The second misregistration correction process allows a lesser amount of toner to be consumed in that reference patterns are actually formed in fewer colors. In addition, the processing time can be reduced. However, toner consumption can be further diminished and processing time further reduced by having the reference patterns be formed at only one of the two above-indicated positions.

The following describes an example in which K-color and C-color reference patterns are formed and misalignment readings are calculated in the primary and auxiliary scanning directions for the C-color relative to the K-color reference pattern.

Figure 5:
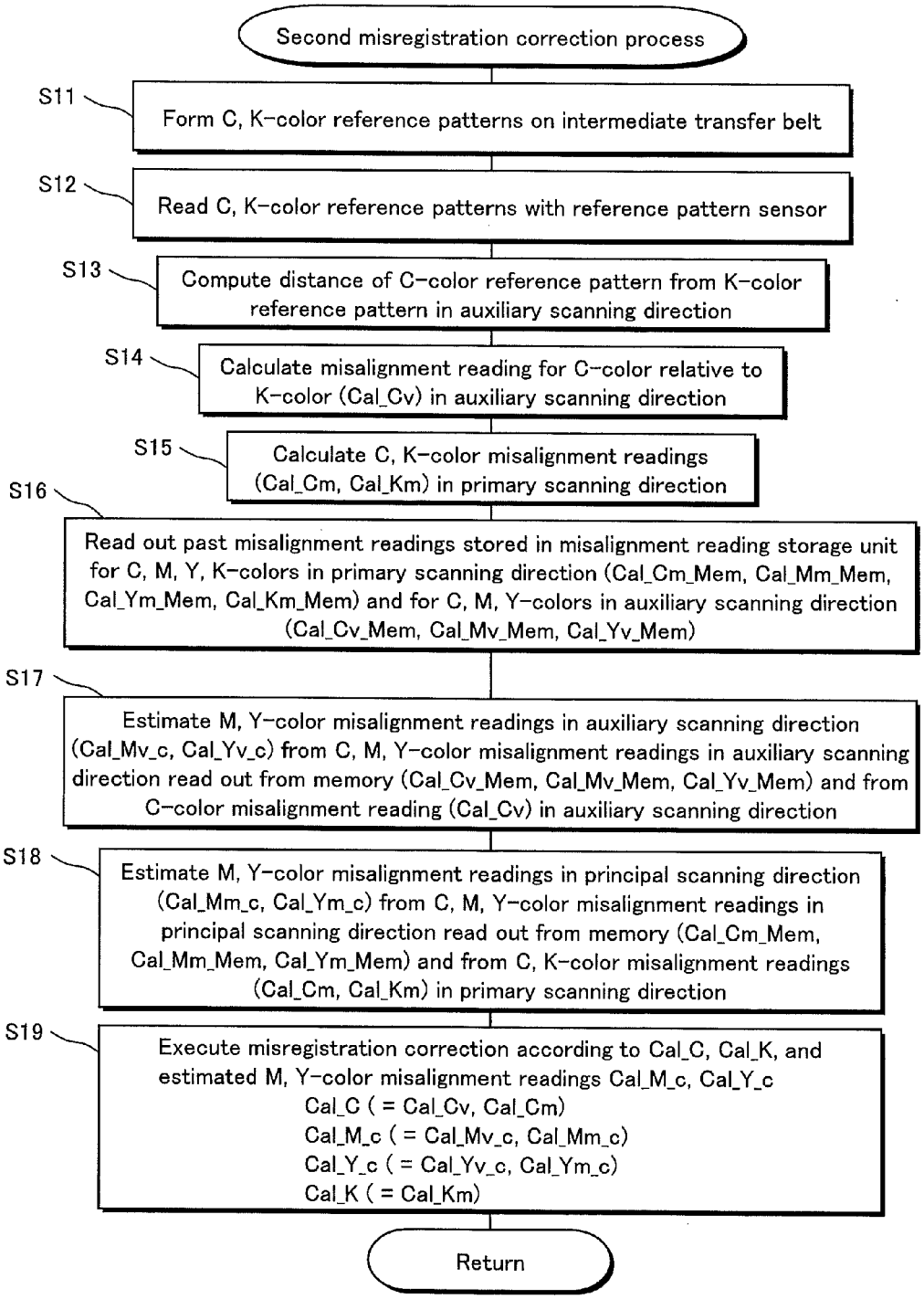
FIG. 5 is a flowchart showing the content of a second misregistration correction process.

FIG. 5 is a flowchart showing the content of the second misregistration correction process. This process is incorporated in the flow of the later-described print job execution process (see FIG. 8) as a sub-routine.

To avoid redundancies, components identical to those of the first misregistration correction process are indicated with the same reference symbols, and the description thereof is omitted.

First, reference patterns 101 and 102 are formed as illustrated on the left-hand side of FIG. 3 at a position corresponding to one end of the primary scanning direction along the intermediate transfer belt 38 (step S11). The reference patterns 101 and 102 so formed are, respectively, 101K, 101C, 102K, and 102C, only.

The reference patterns so formed pass by the detection position of the reference pattern sensor 34*a* due to the motion of the intermediate transfer belt 38. At this point, the patterns are respectively read (step S12).

The distance of the C-color reference pattern from the reference position of the K-color reference pattern in the auxiliary scanning direction is computed from the reference pattern 101 readings taken by the reference pattern sensor 34*a*. The difference between the distance so computed and distance expected in the absence of misregistration is then used to calculate misalignment readings (Cal_Cv) in the auxiliary scanning direction (steps S13 and S14).

Then, the line spacing between the first linear portions and the line spacing between the second linear portions is computed for each color, C and K, from the reference pattern 102 readings in order to calculate misalignment in the primary scanning direction (Cal_Cm, Cal_Km) in each color (step S15).

Subsequently, the misalignment readings stored in the misalignment reading storage unit 708 that were obtained in previously-executed first misregistration correction processes for each color C, M, Y, and K in the primary scanning direction (Cal_Cm_Mem, Cal_Mm_Mem, Cal_Ym_Mem, and Cal_Km_Mem) and for the C, M, and Y colors in the auxiliary scanning direction (Cal_Cv_Mem, Cal_Mv_Mem, and Cal_Yv_Mem) are read out (step S16).

Next, the misalignment readings for the M and Y colors in the auxiliary scanning direction (Cal_Mv_c, Cal_Yv_c) are estimated from the misalignment readings for the C, M, and Y colors in the auxiliary scanning direction read out in step S16 (Cal_Cv_Mem, Cal_Mv, Mem, Cal_Yv_Mem) and from the misalignment reading for the C color in the auxiliary scanning direction calculated in step S14 (Cal_Cv) (step S17).

The misalignment readings for the M and Y colors in the primary scanning direction are then estimated from the misalignment readings for the C, M, and Y colors in the primary scanning direction (Cal_Cm_Mem, Cal_Mm_Mem, Cal_Ym_Mem) read out in step S16 and from the misalignment readings for the C and K colors in the primary scanning direction (Cal_Cm, Cal_Km) (step S18). The misalignment readings so estimated are hereinafter referred to as estimated misalignment and indicated with the suffix_c, as in Cal_Mm_c and Cal_Ym_c.

Widely-known misregistration corrections are carried out according to Cal_Cv calculated in step S14, Cal_Cm and Cal_Km calculated in step S15, Cal_Mv_c and Cal_Yv_c estimated in step S17, and Cal_Mm_c and Cal_Ym_c estimated in step S18 so as to prevent misregistration during color image formation (step S19). The process flow then returns to the print job execution process illustrated by FIG. 8.

The above-described estimated misalignment calculation method is described below using the specific example of the M-color estimated misalignment in the primary scanning direction Cal_Mm_c.

Cal_Mm_c can be computed as follows. First, the C-color misalignment reading in the primary scanning direction obtained in step S15 (Cal_Cm) is divided by the C-color misalignment reading in the primary scanning direction read out from the misalignment reading storage unit 708 in step S16 (Cal_Cm_Mem) to obtain a reference ratio (Cal_Cm/Cal_Cm_Mem). Then, the reference ratio so calculated is multiplied by the M-color misalignment reading in the primary scanning direction read out from the misalignment reading storage unit 708 in step S16 (Cal_Mm_Mem). The result of this computation is Cal_Mm_c.

The above calculation is expressed by the following equation:

$$Cal_Mm_c = Cal_Mm_Mem(Cal_Cm/Cal_Cm_Mem)$$

The same computation can be performed for each of Cal_Mv_c, Cal_Ym_c, and Cal_Yv_c by substituting the appropriate value read out from the misalignment reading storage unit 708 and multiplying by the above-inscribed ratio (Cal_Cm/Cal_Cm_Mem).

If steps S11 through S18 of the second misregistration correction process illustrated by FIG. 5 as described above are considered to be a second misalignment reading acquisition process, then the misregistration correction unit 710 that executes the misregistration correction process in step S19 so as to correct the misalignment reading obtained during that process (by measurement and estimation) can be considered to be a second misregistration correction unit.

The above explanation describes an example in which a reference pattern is formed at a position readable by the reference pattern sensor 34*a*. However, the present invention is not limited in this manner. The reference pattern may be formed at a position readable by the reference pattern sensor 34*b*.

Also, in the above explanation, reference patterns in the two colors K and C are formed for the second misregistration correction process such that misalignment readings in the primary and auxiliary scanning directions are calculated for the C-color relative to the reference position of the K-color pattern. However, the present invention is not limited in this manner. Reference patterns may be formed in any two of the colors C, M, Y, and K, and misalignment readings in the primary and auxiliary scanning directions may be calculated for any one of two of the colors relative to the reference position of the other one of the two colors. In such a case, a ratio of the misalignment reading so calculated to the corresponding value stored in the misalignment reading storage unit 708 is computed. Misalignment readings can then be estimated for the remaining two colors by multiplying the computed ratio by the value stored in the misalignment reading storage unit 708 for each color.

4. Misregistration Correction Flag-Setting Process

(4-1. First Misregistration Correction Flag-Setting Process)

Figure 6:
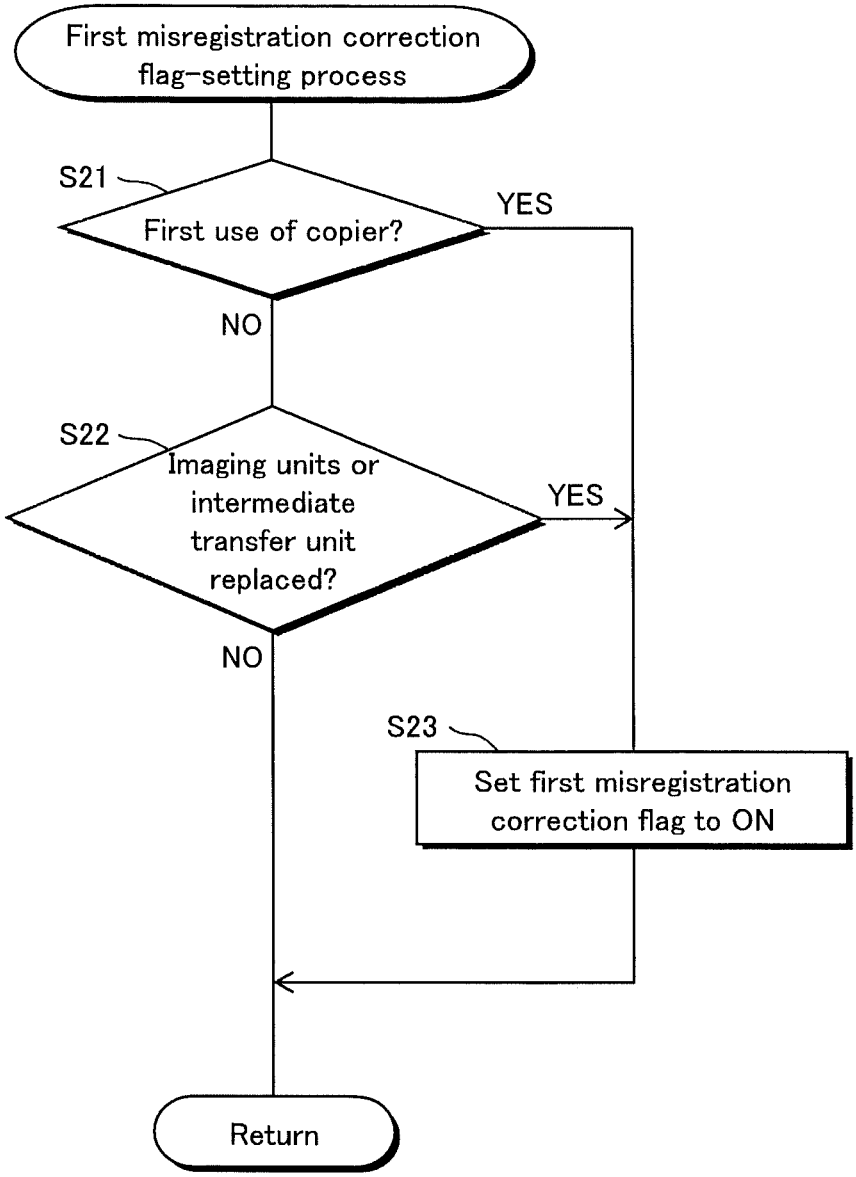
FIG. 6 is a flowchart showing the content of a first misregistration correction flag-setting process.

FIG. 6 is a flowchart showing the content of the first misregistration correction flag-setting process. The first misregistration correction flag-setting process is executed by the CPU 701 and so on in accordance with a control program stored in the ROM 706. Although not indicated in the figure, a main routine that controls the entire copier 1 exists independently, and the first misregistration correction flag-setting process, which is a sub-routine, is executed every time the sub-routine is called by the main routine. Such calls may be performed, for example, at predetermined intervals while the copier 1 power supply is ON, specifically at intervals of a few seconds.

First, a determination is made as to whether or not the copier 1 is being used for the first time (step S21). This determination is, for instance, carried out as follows. A flow is set up so as to cycle with every power-up and to increment a counter by one with every cycle. The counter is reset to zero when the copier 1 is shipped. The determination process executed in step S21 then references this counter, making a positive determination that the copier is being used for the first time if the value of the counter is zero, and a negative determination otherwise.

If the determination made in step S21 is positive, then the first misregistration correction flag is set to ON (Yes in step S21, step S23) and the process returns to the main routine.

If the determination made in step S21 is negative, then a subsequent determination is made as to whether or not any of the imaging units 9 or the intermediate transfer unit 30 have been replaced (No in step S21, step S22). The determination as to whether or not any of the imaging units 9 or the intermediate transfer unit 30 have been replaced can be made by detecting whether the main body door of the copier 1 has been opened and shut. Cases may arise in which the main body door of the copier 1 has been opened and shut without the imaging units 9 or the intermediate transfer unit 30 having been replaced. However, the act of opening and shutting the door is taken as indicative of work being performed within the body of the copier. Thus, the possibility exists that the mounting positions of the imaging units have been affected by such work. In the present Embodiment, this is deemed equivalent to replacement.

If the determination made in step S22 is negative, i.e., if the imaging units 9 and intermediate transfer unit 30 have not been replaced (No in step S22), then the process returns to the main routine.

If the imaging units 9 or the intermediate transfer unit 30 are found to have been replaced, then the first misregistration correction flag is set to ON (Yes in step S22, step S23) and the process returns to the main routine.

(4-2. Second Misregistration Correction Flag-Setting Process)

Figure 7:
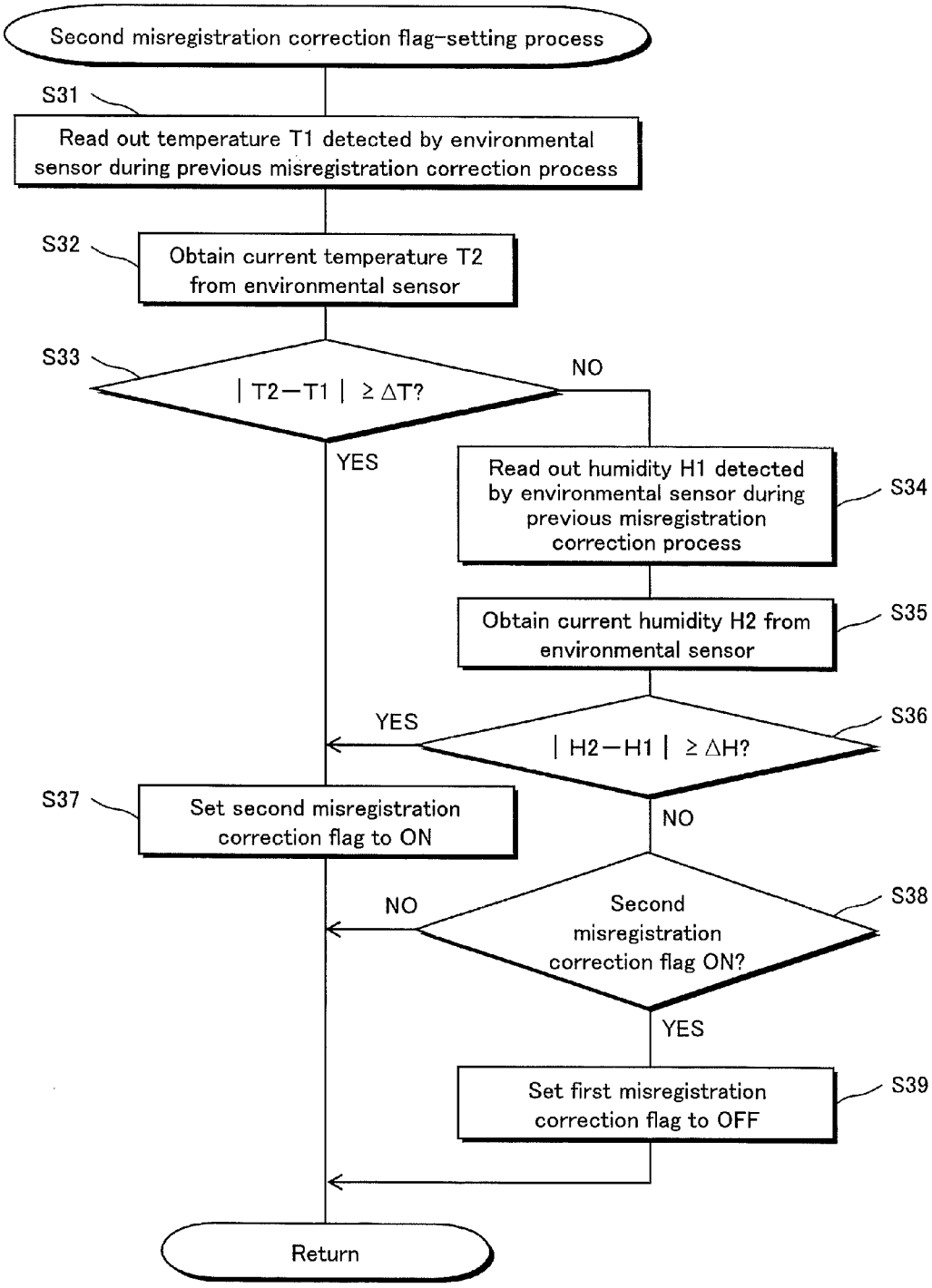
FIG. 7 is a flowchart showing the content of a second misregistration correction flag-setting process.

FIG. 7 is a flowchart showing the content of the second misregistration correction flag-setting process. The second misregistration correction flag-setting process is executed by the CPU 701 and so on in accordance with a control program stored in the ROM 706. Although not indicated in the figure, a main routine that controls the entire copier 1 exists independently, and the second misregistration correction flag-setting process, which is a sub-routine, is executed every time the sub-routine is called by the main routine. Such calls may be performed, for example, at predetermined intervals while the copier 1 power supply is ON, specifically at intervals of a few seconds.

Let the internal copier 1 temperature detected by the environmental sensor 49 be T, such that the value of T detected during the previous misregistration correction process is T1 and the current value of T is T2. Similarly, let the internal copier 1 humidity detected by the environmental sensor 49 be H, such that the value of H detected during the previous misregistration correction process is H1 and the current value of H is H2. The symbols T, T1, T2, H, H1, and H2 are hereinafter taken to have the above-described definitions.

The previous misregistration correction process here referred to may be either of the first and second misregistration correction processes.

First, information stored in the correction-time hygrothermal reading storage unit 709 indicating the temperature T1 detected during the previous misregistration correction process is read out (step S31).

Next, the current temperature T2 is read (step S32). Then, a determination is made as to whether the difference between T2 and T1 is equal to or greater than a predetermined value ΔT (step S33). The difference is an absolute value. The determination is made using the absolute value relative to the predetermined value ΔT, regardless of whether subtracting T1 from T2 gives a positive or negative result. The predetermined value ΔT is set such that temperature changes equal to or greater than the range expressed thereby would plausibly cause thermal expansion or the like in the intermediate transfer belt 38 or other parts, in turn leading to misregistration during image formation. ΔT may be, for example, 5° C. The value of ΔT is computed in advance through experimentation or similar and stored in a storage unit such as the ROM 706.

If the determination is such that the difference between the temperatures T2 and T1 is greater than or equal to the value of ΔT, then the second misregistration correction flag is set to ON (Yes in step S33, step S37) and the process returns to the main routine.

On the other hand, if the difference is less than the value of ΔT (No in step S33), then information stored in the correction-time hygrothermal reading storage unit 709 indicating the humidity H1 detected during the previous misregistration correction process is read out (step S34). Afterward, the current humidity H2 is detected (step S35) and a determination is made as to whether the difference between H2 and H1 is equal to or greater than a predetermined value ΔH (step S36). This difference is also an absolute value. The predetermined value ΔH is set such that humidity changes equal to or greater than the range expressed thereby would plausibly lead to expansion or the like in the intermediate transfer belt 38 or other parts, in turn leading to misregistration during image formation. ΔH may be, for example, 30%. The value of ΔT is computed in advance through experimentation or similar and stored in a storage unit such as the ROM 706.

If the determination is such that the difference between the H2 and H1 is greater than or equal to the value of ΔH then the second misregistration correction flag is set to ON (Yes in step S36, step S37) and the process returns to the main routine.

On the other hand, if the difference is less than the value of ΔH (No in step S36), then a determination is made as to whether or not the second misregistration correction flag is ON (step S38). If the second misregistration correction flag is not ON (i.e., is OFF), then the process returns as-is to the main routine. In such a case, no misregistration correction flag is set (no flag is ON). However, if the second misregistration correction flag is ON (Yes in step S38), then the second misregistration correction flag is turned OFF (step S39) and the process returns to the main routine. Accordingly, if the difference between T2 and T1 and/or between H2 and H1 ever comes to be equal to or greater than the predetermined values of ΔT and ΔH, respectively, then a misregistration correction flag is turned ON. If the two differences then come to be less than the predetermined values before the misregistration correction process is performed, unnecessary misregistration corrections due to the second misregistration correction flag remaining ON can be avoided.

The above-described sequences of steps to determine whether the difference between T2 and T1 is greater than or equal to the predetermined value ΔT (steps S31 through S33) and to determine whether the difference between H2 and H1 is greater than or equal to the predetermined value ΔH (steps S34 through S36) are not restricted to the above and may be performed in reverse order. That is, whether the difference between H2 and H1 is greater than or equal to the predetermined value ΔH may be determined before determining whether the difference between T2 and T1 is greater than or equal to the predetermined value ΔT.

5. Print Job Execution Process

Figure 8:
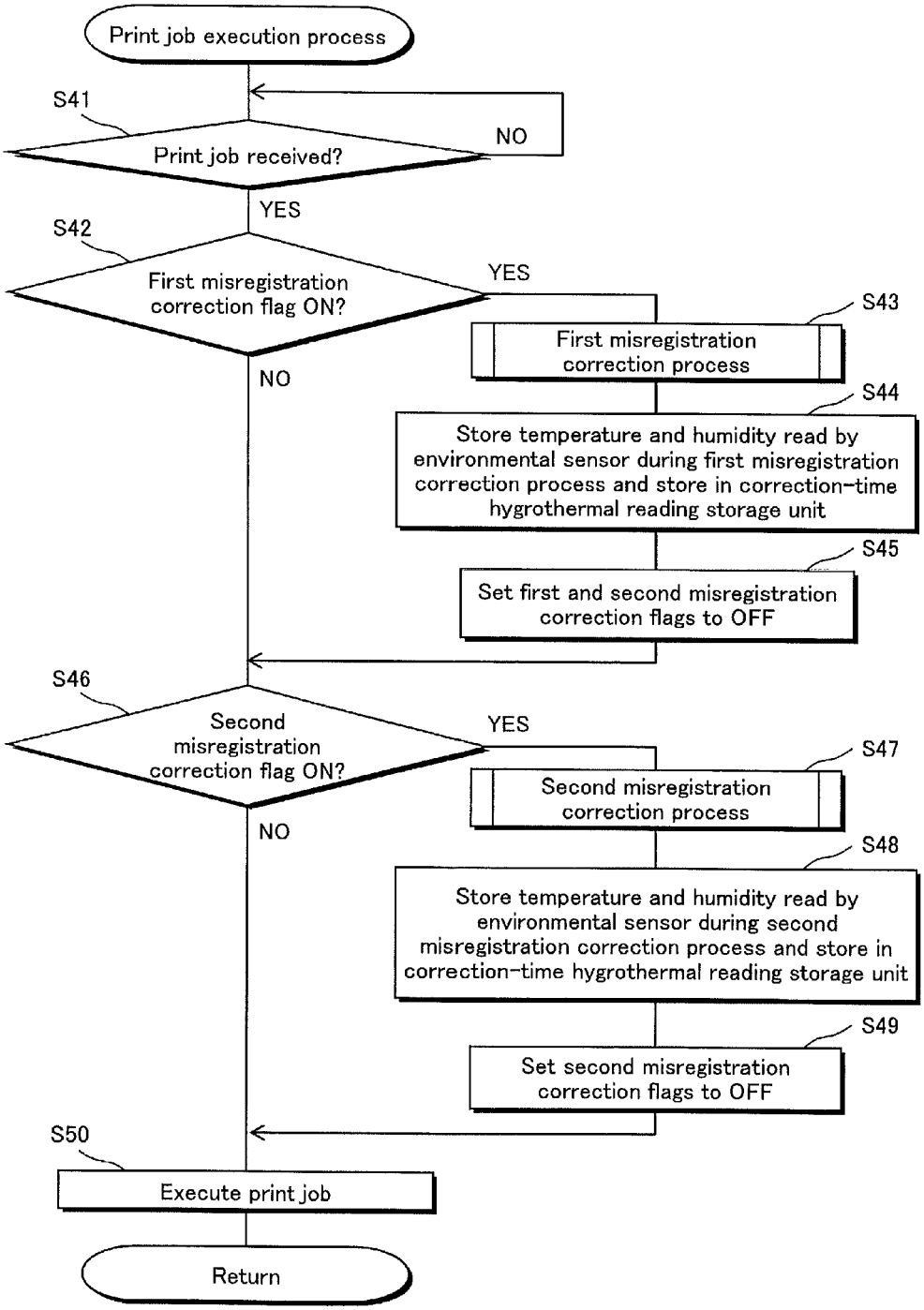
FIG. 8 is a flowchart showing the content of a print job execution process.

FIG. 8 is a flowchart illustrating the content of the print job execution process. The print job execution process is executed by the CPU 701 and so on in accordance with a control program stored in the ROM 706. This flowchart is also executed at every call therefor within the (non-diagrammed) main routine, which controls the overall operations of the copier 1.

As shown, upon reception of a print job, a determination is made as to whether or not the first misregistration correction flag is ON (Yes in step S41, step S42).

If the first misregistration correction flag is ON, then the first misregistration correction process (see FIG. 4) is performed (Yes in step S42, step S43).

The temperature T and humidity H read by the environmental sensor 49 during first misregistration correction process execution are then procured and stored in the correction-time hygrothermal reading storage unit 709. After the first and second misregistration correction flags are set to OFF, a determination is made as to whether or not the second misregistration correction flag is still ON (step S44, step S45, step S46).

If the first misregistration correction flag is not ON in step S42 (i.e., is OFF), then a determination is made as to whether or not the second misregistration correction flag is ON (No in step S42, step S46).

If the second misregistration correction flag is ON, then the second misregistration correction process (see FIG. 5) is performed (Yes in step S46, step S47).

The temperature T and humidity H read by the environmental sensor 49 during second misregistration correction process execution are then procured and stored in the correction-time hygrothermal reading storage unit 709 (step S48). After the misregistration correction flags are set to OFF (step S49), the print job received in step S41 is executed (step S50) and the process returns to the main routine.

If the second misregistration correction flag is not ON in step S46 (i.e., is OFF), then the print job received in step S41 is promptly executed (No in step S46, step S50) and the process returns to the main routine.

6. Conclusion

As described, the present Embodiment corrects for misalignment caused by minute mounting misalignment of the imaging units 9 and the intermediate transfer unit 30 in the first misregistration correction process according to readings obtained by taking measurements from reference patterns written in each of the colors C, M, Y, and K.

Then, misalignment owed to hygrothermal changes within the apparatus causing expansion or contraction in the photosensitive drums 21, in the intermediate transfer belt 38, and in the cases of the imaging units 9 is measured by taking misalignment readings in two of the four colors C, M, Y, and K. Misalignment readings for the remaining two colors are then estimated from the readings in the two measured colors and from misalignment readings in all four colors C, M, Y, and K taken during previous executions of the first misregistration correction process. Misalignment corrections are then performed through the second misregistration correction process according to the two estimated misalignment readings and the two measured misalignment readings.

According to the above-described structure, the frequently-executed second misregistration correction process only takes measurements for misalignment readings in two colors. This makes possible shorter processing times in contrast to conventional misregistration correction that requires measurements in all four colors. Thus, the user is inconvenienced less frequently, which contributes to a user-friendly experience. Furthermore, this structure contributes to reduction of toner consumption and of costs.

In addition, the estimation of misalignment readings in two colors according to measured misalignment readings in two other colors and past misalignment readings in all four colors enables responsive corrections to misalignment caused by internal hygrothermal changes. Thus, image quality can be preserved by ensuring minute misregistration corrections.

Furthermore, cost escalation can be controlled as no new materials need be installed in order to realize the present Embodiment.

(Variations)

The present invention has been described above with reference to the Embodiment. However, the present invention is not limited in this manner. The following variations are also possible.

(1) In the above-described Embodiment, the second misregistration correction process is described through an example in which reference patterns are formed in the colors C and K by the imaging units 9C and 9K. However, the present invention is not limited in this manner. The reference patterns may also be formed when the order of the imaging units is instead 9C, 9M, 9Y, and 9K, as long as the two neighboring imaging units 9 furthest downstream in the direction of travel of the intermediate transfer belt 38 are used.

Conventionally, the imaging units 9 are arranged as shown in FIG. 1, downstream along the direction of travel of the intermediate transfer belt 38 in the order Y, M, C, K. In many cases, the reference pattern detection unit 34 is provided between the downstream-most imaging unit 9K and the secondary transfer position 48. Accordingly, the Embodiment has reference patterns formed in two colors, C and K, for use in the second misregistration correction process, the K-color imaging unit 9K being nearest and the C-color imaging unit 9C being second-nearest to the reference pattern detection unit 34. Thus, the distance that the intermediate transfer belt 38 must travel to bring the reference patterns so formed into reading range for the reference pattern detection unit 34 can be made as short as possible. Accordingly, the time needed to read the reference patterns can be reduced, in turn reducing the second misregistration correction processing time. In addition, the distance that the intermediate transfer belt 38, with the reference patterns formed thereon, must travel to reach the cleaning blade 35 and have the reference patterns removed therefrom after reading by the reference pattern detection unit 34 can be diminished. This can, in turn, constrain degradation of the intermediate transfer belt 38 caused by friction with the cleaning blade 35, effectively improving longevity.

The order of arrangement of the imaging units 9 of each color may differ from that shown in FIG. 1. In such cases, the above-described effects can be obtained by forming reference patterns with the two imaging units 9 among the plurality of imaging units that are furthest downstream in the direction of travel of the intermediate transfer belt 38 and by measuring misalignment readings therefrom.

(2) In the above-described Embodiment, the two reference patterns formed for the second misregistration correction process are in the colors C and K. However, the present invention is not limited in this manner. Any two of the colors C, M, Y, and K may be used. Also, the reference pattern in the K color need not be used for the reference position.

In fact, the two colors used to form the reference patterns need not include the K color. The K color (black) is often used for text information printing, and misalignment is not always obvious. Also, black can easily cover other colors (C, M, and Y) in image printing and the like, thus masking misalignment. Accordingly, by using reference patterns in colors other than K, in which misalignment is more obvious, to measure misalignment readings, misregistration correction can be carried out with greater accuracy, thus effectively preserving better image quality.

(3) In the above-described Embodiment, the second misregistration correction process is executed by forming reference patterns with the same two imaging units in every instance. However, the present invention is not limited in this manner. Different imaging units 9 may be used to form the reference patterns every instance, or the imaging units used to form the reference patterns may be changed after a set number of uses, for example, every three times the process is performed.

Accordingly, the user can be spared the inconvenience of the situation in which a specific toner cartridge must frequently be replaced due to accelerated consumption owed to constant use of the same specific color to execute the second misregistration correction process. This contributes to user-friendliness.

Additionally, misalignment readings are measured from the four imaging units 9 in rotation over a certain time interval. Estimated misalignment readings can thus be kept in use for a shorter period, thereby avoiding scenarios in which a gradually-increasing discrepancy arises between the measured and estimated misalignment readings.

(4) In the above-described Embodiment, misregistration corrections are carried out only between the reception and completion of a print job, even when the misregistration correction flags are ON. However, misregistration corrections may be performed under other scenarios as well, such as when power supply status is changed, e.g., when the power supply is turned on and when the apparatus recovers from sleep mode, provided that the first or second misregistration correction flag is deemed to be ON.

When the apparatus is initialized or recovers from sleep mode, there is a high probability that a print job will be received shortly. If misregistration correction flags are ON and misregistration corrections are performed at these times, there is no need to perform new misregistration corrections upon receipt of a print job. Thus, the user is not inconvenienced by the wait for misregistration corrections to be performed after issuing a print job.

Figure 9:
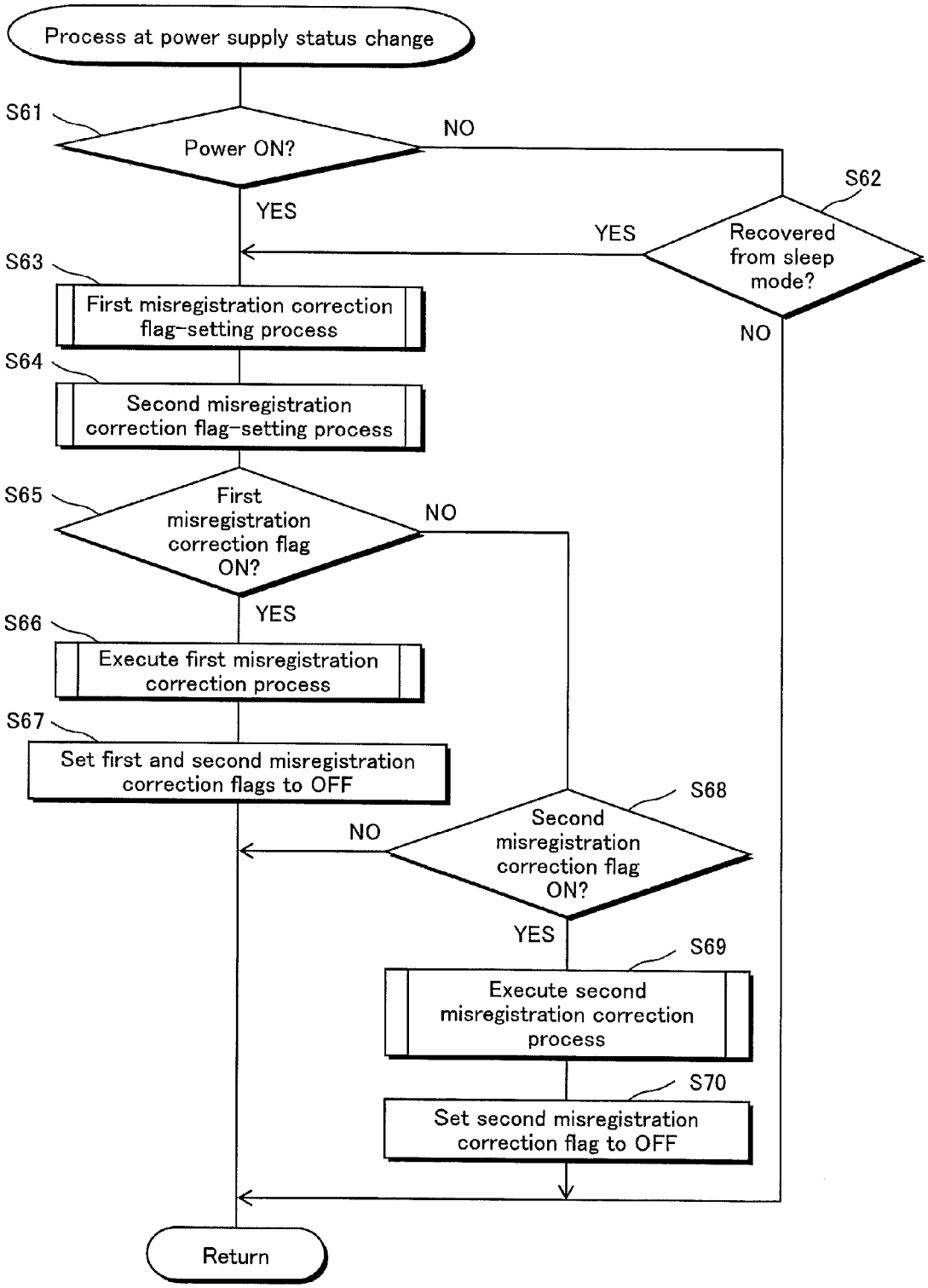
FIG. 9 is a flowchart showing the content of a process performed when changes to a power supply status occur, pertaining to Variation 4.

FIG. 9 is a flowchart illustrating the process performed when changes to the power supply status occur, pertaining to the present variation. First, a determination is made as to whether the power supply has been switched from OFF to ON (step S61).

If the power supply has been switched ON, the first misregistration correction flag-setting process (see FIG. 6) is performed, followed by the second misregistration correction flag-setting process (see FIG. 7). Afterward, a determination is made as to whether or not the first misregistration correction flag is ON (Yes in step S61, step S63, step S64, step S65).

If the power supply has not been switched from OFF to ON in step S61, a determination is made as to whether or not the apparatus has recovered from sleep mode (No in step S61, step S62).

If the apparatus has recovered from sleep mode, the first misregistration correction flag-setting process (see FIG. 6) is performed, followed by the second misregistration correction flag-setting process (see FIG. 7). Afterward, a determination is made as to whether or not the first misregistration correction flag is ON (Yes in step S62, step S63, step S64, step S65).

If the apparatus has not recovered from sleep mode (No in step S62), then changes to the power supply status have not occurred, and the process returns as-is to the main routine.

If the first misregistration correction flag is ON in step S65, then the first misregistration correction process (see FIG. 4) is performed, and the first and second misregistration correction flags are subsequently turned OFF (Yes in step S65, step S66, step S67). The process then returns to the main routine.

If the first misregistration correction flag is not ON in step S65, then a determination is made as to whether or not the second misregistration correction flag is ON (No in step S65, step S68).

If the second misregistration correction flag is not ON (No in step S68), then the process returns to the main routine as neither one of the misregistration correction flags is ON.

If the second misregistration correction flag is ON, the second misregistration correction process (see FIG. 5) is executed, and the second misregistration correction flag is subsequently turned OFF (Yes in step S68, step S69, step S70). The process then returns to the main routine.

The temperature and humidity readings taken by the environmental sensor 49 when the first and second misregistration correction processes are performed may be stored in the correction-time hygrothermal reading storage unit 709 as is done during steps S44 and S48 shown in FIG. 8 for the next second misregistration correction flag-setting process.

(5) In the above-described Embodiment, the first misregistration correction process is performed only at initial setup time and when the imaging units or the intermediate transfer unit are replaced. However, the present invention is not limited in this manner. The first misregistration correction process may, for example, be performed in response to user instructions made through the control panel 8 upon visual confirmation of poor image quality, or to instructions to such effect input from an external terminal.

Furthermore, user instructions are not restricted to ordering the execution of the first misregistration correction process but may also be input to order the execution of the second misregistration correction process, or to allow the user to select one of the two processes.

(6) In the above-described Embodiment, the first and second misregistration flag-setting processes shown in FIGS. 6 and 7 are performed whenever the appropriate sub-routines are called in the main routine cycle, i.e., at predetermined intervals, as long as the copier 1 power supply is ON, regardless of whether a print job has been received.

However, repetition of the misregistration flag-setting process only between the reception of a print job by the copier 1 and the conclusion of that print job is quite acceptable.

In such a case, the first misregistration correction flag-setting process (see FIG. 6) and the second misregistration correction flag-setting process (see FIG. 7) should be performed in the flow illustrated by FIG. 8 immediately after reception of the print job (between steps S41 and S42).

(7) The environmental sensor 49 is not limited to reading the internal atmospheric temperature near the driving roller 31 but may also be located near the image processing unit 4, or take temperature measurements directly from the intermediate transfer belt 38.

(8) In the above-described Embodiment, a tandem-type structure is described in which toner images in each color having undergone a primary transfer to the intermediate transfer belt 38 are combined in a secondary transfer to the recording sheets S at the secondary transfer position 48. However, the present invention is not limited in this manner. An alternate structure in which, for instance, a transfer material transporter is provided in the place of the intermediate transfer belt 38 such that the recording sheets or other transfer materials are transported thereon while secured through suction or similar, and the images in each color are successively transferred to the material so transported. According to such a structure, the reference patterns formed on the photosensitive drums 21C, 21M, 21Y, and 21K are the object of transfer onto the transfer material or recording sheets. The misalignment readings can then be taken by a sensor such as the reference pattern detection unit 24 from the reference patterns so transferred.

(9) In the above-described Embodiment, skew corrections are performed by modifying the memory address of pixel data expanded from bitmaps. However, the present invention is not limited in this manner. Such corrections can also be performed by controlling the physical mounting angle of the cylindrical lens within the exposure unit 10.

Similarly, in the above-described Embodiment, misalignment corrections in the primary and auxiliary scanning directions are carried out through memory address changes. However, known methods for changing the initial writing position of the photosensitive drums in the primary and/or auxiliary scanning directions by offsetting the image data read time in memory without making address changes may, of course, be used.

(10) In the above-described Embodiment, the second misregistration correction process is timed to occur when the environmental sensor 49 detects hygrothermal changes that are greater than or equal to a predetermined range. However, the present invention is not limited in this manner. The second misregistration correction process may, for example, be executed after a predetermined number (e.g. 1000) of sheets have been processed in image formation jobs. This can be established by providing a revolution sensor to count the number of revolutions made by the photosensitive drums 21C, 21M, 21Y, and 21K and keeping a cumulative sheet count according to the values detected and output by the revolution sensors. The sheet count-based timing control may be freely combined with the above-described temperature- and humidity-based timing controls.

(11) In the above-described Embodiment, the determination as to whether or not the imaging units 9 and the intermediate transfer unit 30 have been replaced is made by detecting whether the main body door of the copier 1 has been opened and shut. However, the present invention is not limited in this manner. The imaging units 9 and the intermediate transfer unit 30 may, alternatively, be provided with a memory storing usage history information therein. The determination can thus be made with reference to the usage history information. If no usage history has been recorded, a determination can be made to the effect that a new unit has been mounted or that the unit is being used for the first time.

Alternatively, the imaging units 9 and the intermediate transfer unit 30 may be provided with a fuse that blows out upon conduction. In such a case, conduction indicates the presence of a new article. A determination can thus be made to the effect that a new unit has been mounted or that the unit is being used for the first time.

(12) In the above-described Embodiment, the second misregistration correction process is executed using two imaging units to form the reference patterns. However, the present invention is not limited in this manner.

Three imaging units may be used to form reference patterns, with a misalignment reading being estimated for the remaining color. In such a case, the reference ratio may be calculated using the misalignment reading of any one color, or by using an average value of two obtained misalignment readings (three for misalignment readings in the primary scanning direction).

Also, given that the misalignment readings in the primary scanning direction in any one color can be computed by forming a reference pattern in that color only, a variation is also possible in which only one imaging unit is used to form a reference pattern while the misalignment readings in the primary scanning direction are estimated for the other three colors. As such, the second misregistration correction process may involve reference pattern formation by one imaging unit only while the misalignment readings in the primary scanning direction are estimated for the other three colors. A certain degree of misregistration correction can be obtained even though misalignment corrections are carried out in the primary scanning direction only.

(13) In the above-described Embodiment, the imaging units number four. However, the present invention is not limited in this manner. The imaging units may also number five or more, or three or fewer.

Even if only two imaging units are provided, then as described above for Variation 12, a certain degree of misregistration correction can nevertheless be obtained by using a misalignment reading in the primary scanning direction computed by forming a reference pattern with one of the two imaging units and then estimating the misalignment reading in the primary scanning direction for the other one.

(14) In the above-described Embodiment, misalignment reading data for all colors are initially stored in the misalignment reading storage unit 708, having been obtained in the first misregistration correction process performed at initial setup time. However, the present invention is not limited in this manner. Misalignment reading data computed through experimentation may, for example, be preemptively stored in the misalignment reading storage unit 708 before shipping. The second misregistration correction process may then be performed by reading out this data. In such a case, the first misregistration correction process is not performed at initial setup time, but is performed when the imaging units 9 or the intermediate transfer unit 30 are replaced. The misalignment reading data so obtained may be used to update the above-described pre-stored data.

Also, the misalignment reading data computed through experimentation may be stored in the ROM 706 or similar. In such a case, the misalignment reading data obtained from the first misregistration correction process executed when the imaging units 9 or the intermediate transfer unit 30 are replaced cannot be used for updating (overwriting). Thus, the obtained misalignment readings may be stored in the misalignment reading storage unit 708 to be subsequently read out therefrom.

(15) In the above-described Embodiment, a copier is used as an example of the image formation device pertaining to the present invention. However, the present invention is not limited in this manner. A printer, fax machine, or other common image formation device is equally applicable. Furthermore, the present invention is not limited to tandem-type printers but is also applicable to any image formation device configured to perform misregistration corrections through misalignment corrections. Further still, the present invention is not restricted to using the photosensitive drums 21 as image carriers but may also use photosensitive belts or similar components.

Finally, the above-described Embodiment and Variations may be freely combined to the extent possible.

The characteristics and effects of the present invention are summarized below.

In one aspect of the present invention, an image formation device comprises: a plurality of imaging units each operable to create toner images in a corresponding color; an intermediate transfer body on which the toner images are overlaid in a primary transfer; a secondary transfer unit operable to perform a secondary transfer of the toner images so overlaid onto a recording sheet; a first misregistration correction unit operable to cause the imaging units to form a reference pattern in each color on the intermediate transfer body, execute a first misalignment reading acquisition process to acquire a misalignment reading for each of the reference patterns, and adjust the imaging units so as to correct the misalignment readings so acquired; a storage unit storing therein the misalignment readings for the reference patterns in each color acquired by executing the first misalignment reading acquisition process; and a second misregistration correction unit operable to cause each of a subset of the imaging units to form a reference pattern in the corresponding color on the intermediate transfer body, execute a second misalignment reading acquisition process, the second misalignment reading acquisition process consisting of: acquiring misalignment readings for the reference patterns formed by the subset of the imaging units, and estimating misalignment readings in each color for which a reference pattern is not formed by the subset of the imaging units according to the misalignment readings so acquired and the misalignment readings stored in the storage unit, and adjust the imaging units so as to correct all of the misalignment readings so acquired.

According to this structure, the first and second misregistration correction units can be selected for use according to the cause of the misalignment, for instance. When the second misregistration correction unit is selected for use, imaging units of fewer colors are used to form reference patterns in comparison to cases in which the first misregistration correction unit is so selected. Thus, toner consumption can be constrained and processing time can be reduced. Simultaneously, misalignment readings in the colors for which reference patterns are not formed are estimated using misalignment readings in the colors for which reference patterns are formed and in which misalignment readings are stored in the storage unit. Thus, minute misalignment in the colors for which reference patterns are not formed can be secured, thereby allowing image quality to be preserved.

Also, in another aspect of the present invention, the imaging units are aligned along a travel direction of the intermediate transfer body, and the subset of the imaging units is defined as: a given imaging unit among the plurality of imaging units provided furthest downstream along the travel direction of the intermediate transfer body; and another imaging unit that neighbors the given imaging unit.

Accordingly, given that the reference pattern sensor that reads the reference patterns is ordinarily disposed downstream in the travel direction of the intermediate transfer body, the distance that the intermediate transfer body must travel in order for the reference patterns to be read can be reduced. Thus, the processing time needed to obtain misalignment readings can be diminished.

Also, in a further aspect of the present invention, the subset of the imaging units forming the reference patterns in the second misalignment reading acquisition process create toner images in colors other than black.

Accordingly, when the misregistration correction process is executed by the second misregistration correction unit, accurate misalignment readings can be obtained from reference patterns formed in colors often used for image formation, rather than black, which is often used for text information. Thus, image quality can be preserved for pictures and other closely-observed images.

Also, in another aspect of the present invention, the second misregistration correction unit redefines the subset of imaging units after the misalignment readings have been acquired in the second misalignment reading acquisition process over a predetermined number of executions of the second misalignment reading acquisition process so as to swap one or more of the imaging units that form the reference patterns with another one or more of the imaging units.

Accordingly, when the misregistration correction process is executed by the second misregistration correction unit, a situation in which toner of a specific color is unevenly consumed due to reference patterns constantly being formed by the imaging unit corresponding to the specific color can be avoided. This can contribute to user-friendliness in that the toner in no specific color need be replaced more frequently than other colors.

Also, in a further aspect of the present invention, the first misregistration correction unit operates under at least one of two scenarios: a scenario in which the device is first used; and a scenario in which the intermediate transfer body has been replaced, and the second misregistration correction unit operates under at least one of three scenarios: a scenario in which an internal temperature change has occurred so as to equal or exceed a predetermined temperature value; a scenario in which an internal humidity change has occurred so as to equal or exceed a predetermined humidity value; and a scenario in which a predetermined number of images have been formed.

Accordingly, accurate misregistration corrections are executed by the first misregistration correction unit by obtaining accurate misalignment readings in all of the colors when the device is first used to correct the mounting position of the imaging units and the intermediate transfer unit, which includes an intermediate transfer body such as an intermediate transfer belt, or when the intermediate transfer unit is replaced, causing mounting position misalignment. Also, misregistration corrections are carried out by the second misregistration correction unit when misalignment occurs due to expansion or contraction of the photosensitive drums, intermediate transfer belt, and the casing for the imaging units in the presence of internal temperature changes or similar. Thus, misregistration corrections in response to the latter, more frequent type of misalignment can be executed with a shorter processing time, which in turn enhances user-friendliness.

Also, in another aspect of the present invention, each of the imaging units includes an image carrier that carries the toner images, and the first misregistration correction unit operates under a scenario in which any of the image carriers has been replaced.

Accordingly, accurate misregistration corrections are carried out by the first misregistration correction unit obtaining accurate misalignment readings in all of the colors when misalignment occurs due to mounting position changes of the photosensitive units, which include a photosensitive drum or other image carrier. Thus, image quality can be preserved.

Additionally, in a further aspect of the present invention, the image formation device further comprises a reception unit operable to receive a user instruction to correct misalignment, wherein the first misregistration correction unit operates under a scenario in which the user instruction has been input and received by the reception unit.

Accordingly, the user can input a misregistration correction instruction upon visually confirming poor image quality. Once such a user instruction has been received, the first misregistration correction unit carries out accurate misregistration corrections by obtaining accurate misalignment readings in all of the colors, thus preserving image quality.

Furthermore, an image correction method can also be realized for execution by an image formation device that comprises the characteristics of the present invention, as described above. The same effects can be obtained thereby.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image formation device, comprising:

a plurality of imaging units each operable to create toner images in a corresponding color;

an intermediate transfer body on which the toner images are overlaid in a primary transfer;

a secondary transfer unit operable to perform a secondary transfer of the toner images so overlaid onto a recording sheet;

a first misregistration correction unit operable to (i) cause the imaging units to form a reference pattern in each color on the intermediate transfer body, (ii) execute a first misalignment reading acquisition process to acquire a misalignment reading for each of the reference patterns, and (iii) adjust the imaging units so as to correct the misalignment readings so acquired;

a storage unit storing therein the misalignment readings for the reference patterns in each color acquired by executing the first misalignment reading acquisition process; and a second misregistration correction unit operable to (i) cause each of a subset of the imaging units to form a reference pattern in the corresponding color on the intermediate transfer body, (ii) execute a second misalignment reading acquisition process, the second misalignment reading acquisition process consisting of:

acquiring misalignment readings for the reference patterns formed by the subset of the imaging units, and estimating misalignment readings in each color for which a reference pattern is not formed by the subset of the imaging units according to the misalignment readings so acquired and the misalignment readings stored in the storage unit, and (iii) adjust the imaging units so as to correct all of the misalignment readings so acquired.

2. The image formation device of claim 1, wherein the imaging units are aligned along a travel direction of the intermediate transfer body, and the subset of the imaging units is defined as:

a given imaging unit among the plurality of imaging units provided furthest downstream along the travel direction of the intermediate transfer body; and another imaging unit that neighbors the given imaging unit.

3. The image formation device of claim 1, wherein the subset of the imaging units forming the reference patterns in the second misalignment reading acquisition process create toner images in colors other than black.

4. The image formation device of claim 1, wherein the second misregistration correction unit redefines the subset of imaging units after the misalignment readings have been acquired in the second misalignment reading acquisition process over a predetermined number of executions of the second misalignment reading acquisition process so as to swap one or more of the imaging units that form the reference patterns with another one or more of the imaging units.

5. The image formation device of claim 1, wherein the first misregistration correction unit operates under at least one of two scenarios: a scenario in which the device is first used; and a scenario in which the intermediate transfer body has been replaced, and the second misregistration correction unit operates under at least one of three scenarios: a scenario in which an internal temperature change has occurred so as to equal or exceed a predetermined temperature value; a scenario in which an internal humidity change has occurred so as to equal or exceed a predetermined humidity value; and a scenario in which a predetermined number of images have been formed.

6. The image formation device of claim 1, wherein each of the imaging units includes an image carrier that carries the toner images, and the first misregistration correction unit operates under a scenario in which any of the image carriers has been replaced.

7. The image formation device of claim 1, further comprising a reception unit operable to receive a user instruction to correct misalignment, wherein the first misregistration correction unit operates under a scenario in which the user instruction has been input and received by the reception unit.

8. An image correction method executed by an image formation device for forming color images through a primary transfer, in which toner images formed by a plurality of imaging units for forming the toner images in a corresponding color are overlaid on an intermediate transfer body, and a secondary transfer, in which the toner images are transferred to a recording sheet, comprising:

a first misregistration correction step including:

a first misalignment reading acquisition sub-step of causing the imaging units to form a reference pattern in each color on the intermediate transfer body and executing a first misalignment reading acquisition process to acquire a misalignment reading for each of the reference patterns; and a first misalignment reading correction sub-step of adjusting the imaging units so as to correct the misalignment readings acquired in the first misregistration reading acquisition sub-step;

a storage step of storing, in a storage unit, the misalignment readings for the reference patterns in each color acquired in the first misalignment reading acquisition sub-step; and a second misregistration correction step including:

a second misalignment reading acquisition sub-step of causing each of a subset of the imaging units to form a reference pattern in the corresponding color on the intermediate transfer body and executing a second misalignment reading acquisition process, the second misalignment reading acquisition process consisting of (i) acquiring misalignment readings for the reference patterns formed by the subset of the imaging units, and (ii) estimating misalignment readings in each color for which a reference pattern is not formed by the subset of the imaging units according to the acquired misalignment readings and the misalignment readings stored in the storage unit; and a second misalignment reading correction sub-step of adjusting the imaging units so as to correct all of the misalignment readings acquired in the second misalignment reading acquisition sub-step.

9. The image correction method of claim 8, wherein the imaging units are aligned along a travel direction of the intermediate transfer body, and the subset of the imaging units is defined as:

a given imaging unit among the plurality of imaging units provided furthest downstream along the travel direction of the intermediate transfer body; and another imaging unit that neighbors the given imaging unit.

10. The image correction method of claim 8, wherein the subset of the imaging units forming the reference patterns in the second misalignment reading acquisition sub-step create toner images in colors other than black.

11. The image correction method of claim 8, wherein in the second misregistration correction step, the subset of imaging units is redefined after a predetermined number of executions of the second misalignment reading acquisition sub-step so as to swap one or more of the imaging units that form the reference patterns with another one or more of the imaging unit, and the second misalignment reading acquisition sub-step is executed.

12. The image correction method of claim 8, wherein execution conditions for the first misregistration correction step include at least one of: a scenario in which the device is first used; and a scenario in which the intermediate transfer body has been replaced, and execution conditions for the second misregistration correction step include at least one of: a scenario in which an internal temperature change has occurred so as to equal or exceed a predetermined temperature value; a scenario in which an internal humidity change has occurred so as to equal or exceed a predetermined humidity value; and a scenario in which a predetermined number of images have been formed.

13. The image correction method of claim 8, wherein the imaging units include an image carrier that carries the toner images, and the first misregistration correction step is executed when any of the image carriers has been replaced.

14. The image correction method of claim 8, wherein the image formation device comprises a reception unit operable to receive a user instruction to correct misalignment, and the first misregistration correction step is executed when the user instruction has been input and received by the reception unit.

* * * * *